US007337986B2

(12) United States Patent
Fukutomi

(10) Patent No.: US 7,337,986 B2
(45) Date of Patent: Mar. 4, 2008

(54) FUEL INJECTION VALVE

(75) Inventor: Norihisa Fukutomi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 238 days.

(21) Appl. No.: 10/544,390

(22) PCT Filed: Feb. 4, 2003

(86) PCT No.: PCT/JP03/01125

§ 371 (c)(1),
(2), (4) Date: Aug. 3, 2005

(87) PCT Pub. No.: WO2004/070200

PCT Pub. Date: Aug. 19, 2004

(65) Prior Publication Data

US 2006/0144958 A1 Jul. 6, 2006

(51) Int. Cl.
*F02M 47/02* (2006.01)
*F02M 59/00* (2006.01)
*F02M 61/00* (2006.01)
*B05B 1/30* (2006.01)

(52) U.S. Cl. ..... 239/88; 239/91; 239/533.2; 239/533.12; 239/585.1; 239/585.3; 239/585.4; 239/585.5

(58) Field of Classification Search ..... 239/88, 239/89, 91, 533.2, 533.12, 533.9, 585.1, 239/585.3, 585.4, 585.5; 251/129.15, 129.21, 251/127
See application file for complete search history.

(56) References Cited

U.S. PATENT DOCUMENTS 4,153,205 A * 5/1979 Parrish, Jr. ..... 239/533.9
4,467,966 A 8/1984 Mueller
5,033,679 A * 7/1991 Golev et al. ..... 239/533.3
5,218,943 A * 6/1993 Takeda et al. ..... 123/531
5,890,660 A * 4/1999 Stevens ..... 239/533.3
5,979,801 A 11/1999 Munezane et al.
6,168,095 B1 * 1/2001 Seitter et al. ..... 239/533.3
6,739,525 B2 * 5/2004 Dantes et al. ..... 239/533.12

FOREIGN PATENT DOCUMENTS

JP 10-184496 A 7/1998
JP 2000-303934 A 10/2000
JP 2002-364497 A 12/2002

* cited by examiner

*Primary Examiner*—Davis D. Hwu
(74) *Attorney, Agent, or Firm*—Sughrue Mion, PLLC

(57) ABSTRACT

In a fuel injection valve for slanted fuel injection, provided between a conical flow path and an injection port is an intermediate flow path having a cylindrical surface coaxial to the conical flow path, so that the injection port has a portion of the cylindrical surface connected to the conical surface of the conical flow path and another portion of the cylindrical surface connected to the cylindrical surface of the intermediate flow path, whereby generation of stagnation of flow of fuel is suppressed to decrease the formation of the carbon deposit. The intermediate flow path has a tapered conical surface that is connected to a downstream side end portion of said cylindrical surface and that includes a diameter gradually decreases in the direction of flow of fuel to cope with where the injection port diameter is small. A cone apex angle of the conical surface of the intermediate flow path is smaller than a cone apex angle of the valve seat surface.

3 Claims, 3 Drawing Sheets

FUEL INJECTION VALVE

TECHNICAL FIELD

This invention relates to a fuel injection valve and particularly to a fuel injection valve for an internal combustion engine in which the fuel injection port is slanted with respect to the central axis.

BACKGROUND ART

The conventional fuel injection valve to which the present invention concerns comprises a valve seat, a valve member aligned with the valve seat and capable of engaging and separating therefrom, and an actuator for actuating the valve member. The valve seat includes a valve seat surface defining a conical flow path having a conical surface that has a diameter decreasing in the direction of flow of the fuel, and an injection port having a cylindrical surface communicating with the conical flow path at its downstream side. The valve member has a substantially conical tip and capable of contacting to and separating from the valve seat surface to control the supply of fuel to the injection port. The injection port is slanted with respect to the central axis of the conical flow path in order to efficiently utilize the energy of the swirling fuel due to a swirler in atomizing the fuel. (See Japanese Patent Laid-Open No. 10-184496, for example)

However, in the fuel injection valve that has a fuel injection port slanted with respect to the valve central axis as above described, the angle defined between the conical surface and the cylindrical surface is small to exhibit an acute angle on a side close to the slanted surface and is large at the other side. Therefore, the fuel that flows along the conical surface looses its flow speed at the downstream of such the acute angle to generate a stagnation, resulting in a cause of a deposit of carbon contained in the fuel on the fuel flow path wall surface corresponding to the stagnation. The stagnation easily generates when the slant angle of the injection port with respect to the central axis of the fuel injection valve is large.

Accordingly, the object of the present invention is to provide a fuel injection valve in which the amount of carbon deposit is small.

DISCLOSURE OF INVENTION

With the above object in view, the fuel injection valve of the present invention comprises a valve seat including an injection port having a valve seat surface defining a conical flow path including a conical surface that gradually decreases in diameter in the direction of flow of fuel, and a cylindrical surface including a central axis slanted with respect to the central axis of the conical flow path, a valve member having a substantially conical tip for contacting and separating with respect to the valve seat surface to control supply of fuel into the injection port, and an actuator for actuating the valve member, the fuel injection valve being characterized in that an intermediate flow path having a cylindrical surface coaxial to the conical flow path is provided between the conical flow path and the injection port, and that the injection port has a portion of the cylindrical surface connected to the conical surface of the conical flow path and another portion of the cylindrical surface connected to the cylindrical surface of the intermediate flow path, whereby generation of stagnation of flow of fuel is suppressed.

BEST MODE FOR CARRYING OUT THE INVENTION

Figure 1:
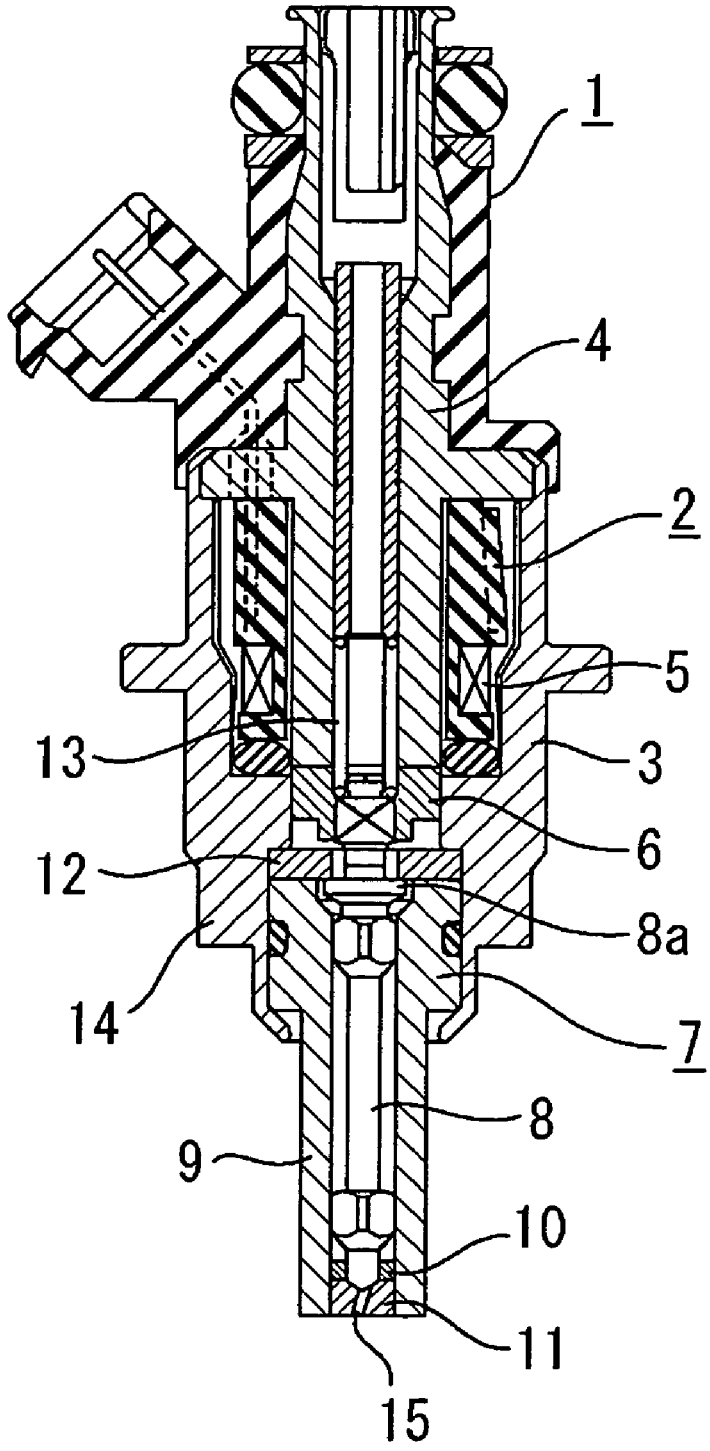
FIG. 1 is a longitudinal sectional view of the fuel injection valve of the present invention.

As illustrated in FIG. 1, a fuel injection valve 1 of the present invention comprises a solenoid unit 2, and the solenoid unit 2 comprises a housing 3 which is also a yoke portion of a magnetic circuit, a core 4 which is a stationary core portion of the magnetic core, a coil 5, an armature 6 which is a movable core portion slidably held by a holder portion 14 of the housing 3, and a spring 13 for biasing the armature 6. The solenoid unit 2 has connected thereto a valve unit 7 to achieve the open and close operation of the valve unit 7, so that the solenoid unit 2 is an actuator. The valve unit 7 comprises a valve member 8 connected to the armature 6, a valve main body 9 connected to the housing 3 via the holder portion 14, a swirler 10 disposed within the valve main body 9 for providing the fuel flow with a swirling motion, a valve seat 11 for controlling the flow of the fuel, and a stopper 12 for restricting the movement of the valve member 8.

When an electric current flows through the coil 5 of the fuel injection valve, a magnetic flux is generated in a magnetic circuit composed of the armature 6, the core 4 and the housing (yoke) 3 to cause the armature 6 to be attracted toward the core 4, whereby the valve member 8 integral to the armature 6 separates from the valve seat 11 to form a clearance therebetween. Then, a high pressure fuel (pressure of 3 MPa) is injected from the injection port 15 into the engine cylinder (not illustrated) and is burned after a few milliseconds. At this time, the fuel injected from the injection port 15 is given a swirling motion energy by the swirler 10 disposed upstream of the valve seat 11 and becomes a spiral flow in the injection port 15 and then injected as a cone-shaped spray into the engine cylinder. When the current supply to the coil 5 is stopped, the magnetic flux in the magnetic circuit decreases to close the clearance between the valve member 8 and the valve seat 11 because of the compression spring 13, terminating the fuel injection. The valve member 8 slides within the valve main body 9 and, in the valve open state, stops with the flange 8*a* brought into abutment with the stopper 12

Figure 2:
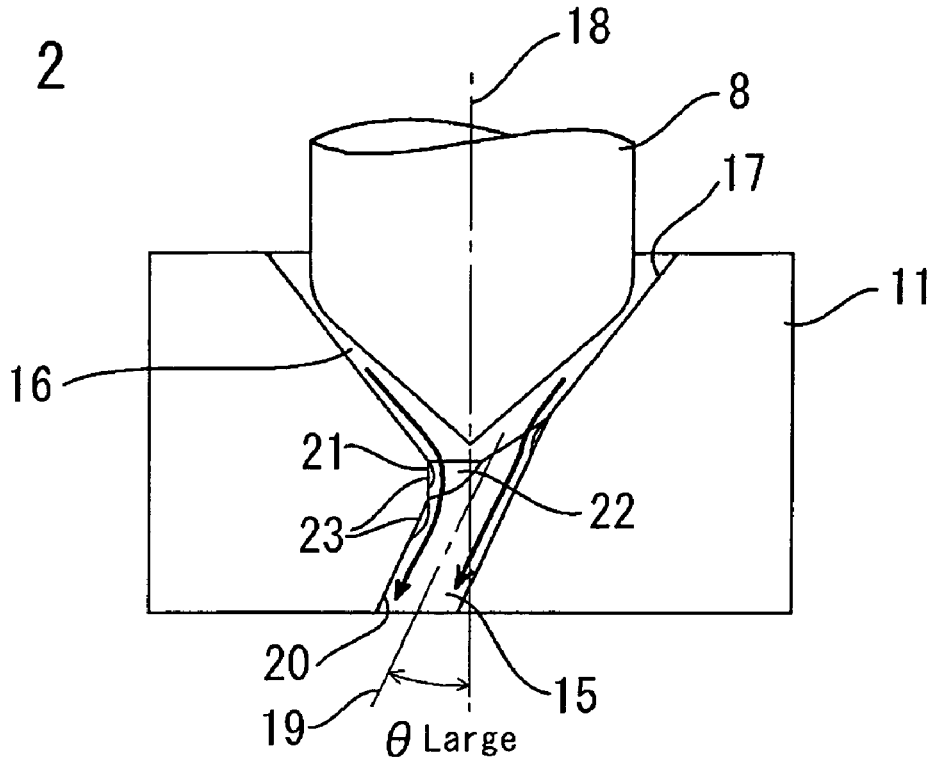
FIG. 2 is an enlarged view showing the fuel flow path between the valve member and the valve seat according to an embodiment of the fuel injection valve of the present invention.

FIG. 2 is an enlarged view showing the fuel flow path between the valve member and the valve seat of the fuel injection valve shown in FIG. 1, in which the state of the valve member 8 being in an open valve position separated from the valve seat 11 is illustrated. The valve seat 11 is provided with a valve seat surface 17 defining a conical flow path 16 including a conical surface having a diameter that gradually decreases in the direction of fuel flow, and the injection port 15 connected at the downstream side of the conical flow path 16 is provided with a cylindrical surface 20 having a central axis 19 slanted with respect to the central axis 18 of the conical flow path 16. The valve member 8 has a substantially cone-shaped tip and is brought into a contacting and separating relationship with respect to the valve seat surface 17 to control the supply of the fuel into the injection port 15.

The valve seat 11 further comprises an intermediate flow path 22 having a cylindrical surface 21 coaxial to the conical flow path 16 between the conical flow path 16 and the injection port 15 (that is, the central axis of the intermediate flow path 22 coincides with the central axis 18 of the conical flow path 16). Since the diameter of the intermediate flow path 22 is substantially equal to that of the injection port 15, the intermediate flow path 22 appears only partially between the conical flow path 16 and the injection port 15, and the cylindrical surface 20 of the injection port 15 has one portion (the portion on the side where the change in the angle relative to the valve seat surface 17 is small) connected to the valve seat surface 17 which is the conical surface of the conical flow path 16 and has another portion (the portion on the side where the change in the angle relative to the valve seat surface 17 is large) connected to the cylindrical surface 21 of the intermediate flow path 22. Therefore, the resulted configuration is such that that portion where the change in the angle between the valve seat surface 17 and the cylindrical surface 20 of the injection port 15 is large is cut off.

According to such arrangement, the flow of the fuel at this portion is made smooth to reduce the loss and to suppress the stagnation, so that the accumulation of the carbon deposit 23 is small as illustrated. The circumference on the upstream side of the injection port 15 is connected at one portion to the intermediate flow path 22 and at a still another portion to the valve seat surface 17, so that the number of the portions at which the fuel flow direction changes is small as compared to that where entire circumference on the upstream side of the injection port 15 is connected to the intermediate flow path 22 and where the flow path is bent. It is to be noted that the particularly advantageous results due to the intermediate flow path 22 can be obtained when the slant angle of the injection ports is large, such as 30 degrees or more.

Figure 3:
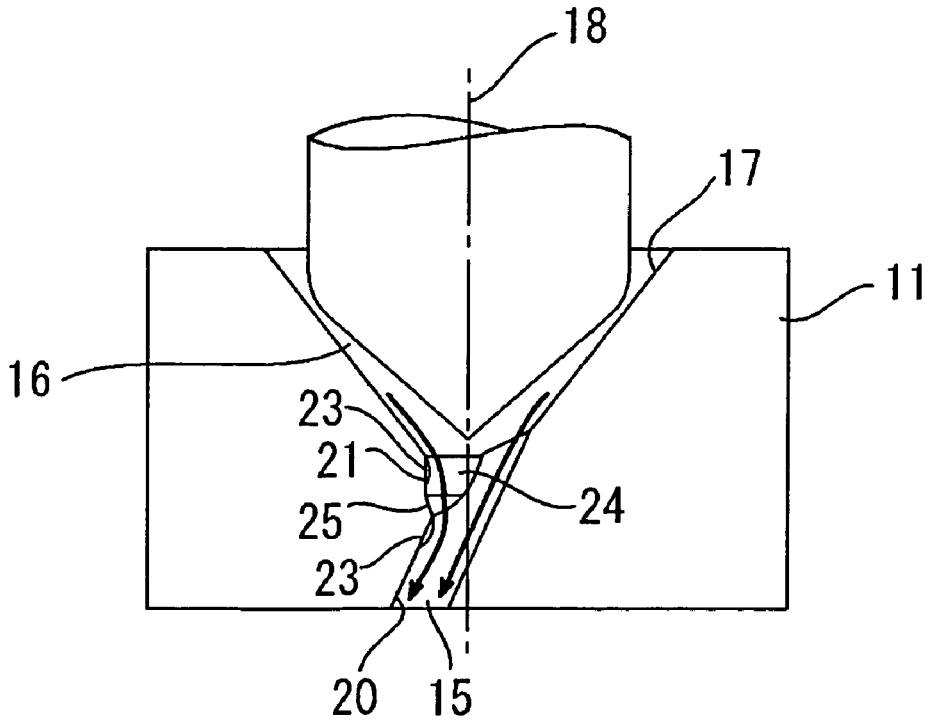
FIG. 3 is an enlarged view showing the fuel flow path according to another embodiment of the fuel injection valve of the present invention.
Figure 4:
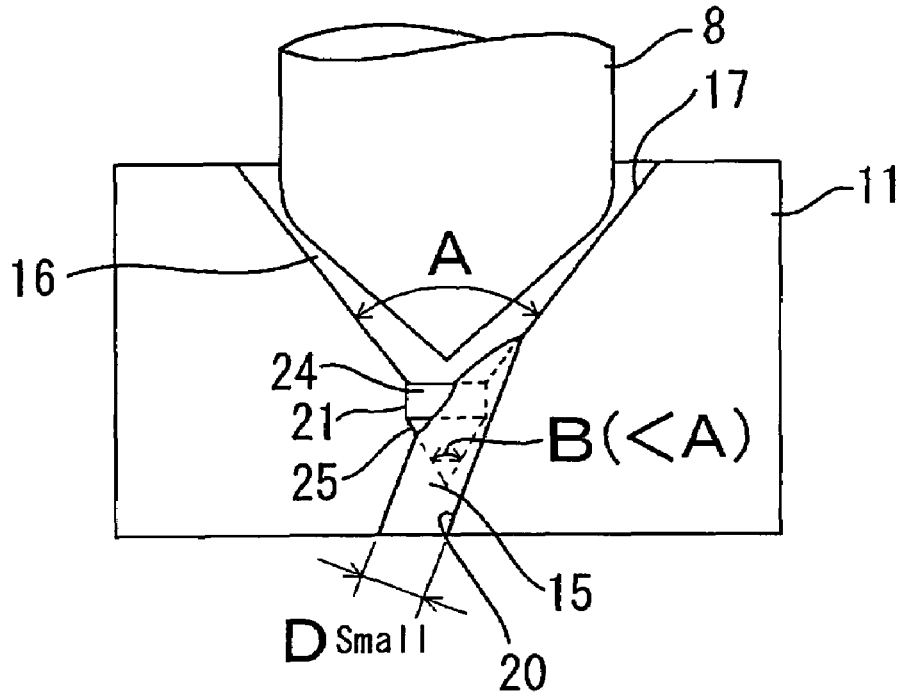
FIG. 4 is an enlarged view for explaining the structure of the fuel injection valve shown in FIG. 3.

FIG. 3 is an enlarged view showing the fuel flow path in another embodiment of the fuel injection valve of the present invention. In this fuel injection valve, as best seen from FIG. 4, the intermediate flow path 24 has a tapered conical surface 25 that is connected to the downstream side end portion of the cylindrical surface 21 and that has a diameter gradually decreases in the direction of flow of the fuel, and the conical surface 25 has one portion of the circumference of the upper end of the cylindrical surface 20 of the injection port 15 previously described. The apex angle B of the conical surface 25 of the intermediate flow path 24 is made smaller than the apex angle A of the conical surface of the valve seat surface 17 (B<A). Thus, the upper end of the injection port 15 is connected to the valve seat surface 17 which is the conical surface of the conical flow path 16, a cylindrical surface 21 of the intermediate flow path 24 and the conical surface 25 of the intermediate flow path 24 and has a configuration that has no significant angle change between the valve seat surface 17 and the injection port 15. Therefore, it is difficult for the carbon deposit 23 that may be formed on the flow path walls to deposits and, even when deposited, the amount may be small.

Figure 5:
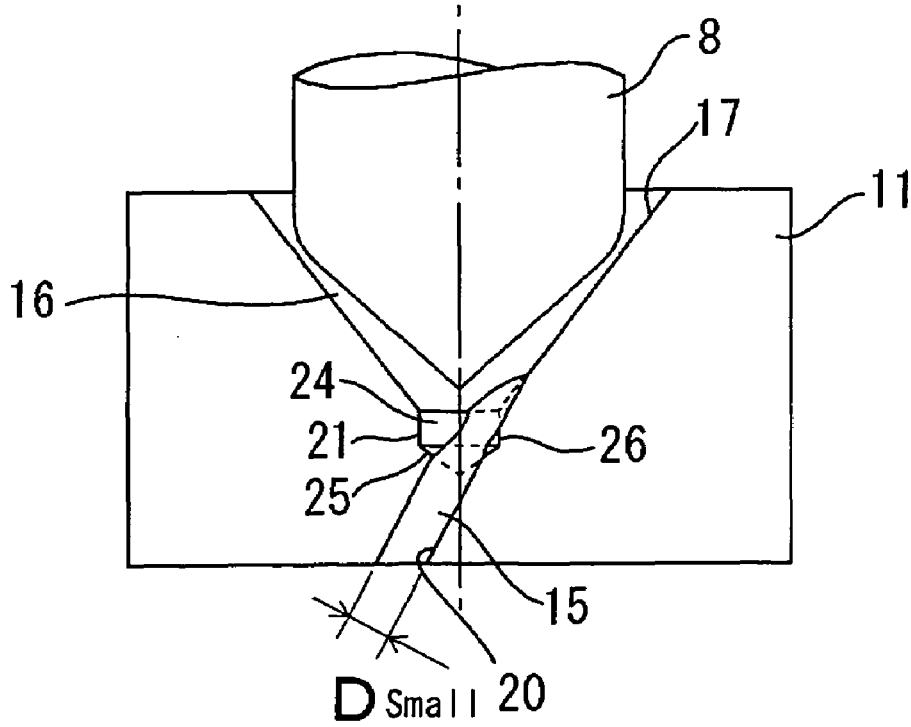
FIG. 5 is an enlarged view showing the fuel flow path when the diameter of the injection port of the fuel injection valve shown in FIGS. 3 and 4 is small.

In this fuel injection valve, the inner diameter of the injection port 15 is small as compared to that of the fuel injection valve illustrated in FIG. 2, and it is prevented that the lower end portion of the intermediate flow path 24 which is the cylindrical flow path cuts into the cylindrical surface 20 of the injection port 15 and forms a dimple 26 therein as shown in FIG. 5.

The advantageous effect obtained by the use of the fuel injection valve of the present invention in an internal combustion engine is that, even when a large slant angle is given to the direction of the fuel injection with respect to the direction of installation of the fuel injection valve, the decrease in amount of fuel injection due to the carbon deposit and the deterioration in atomization of the injected fuel can be minimized, so that the initial engine performance of the new engine can be maintained even after a long time use.

The invention claimed is:

1. A fuel injection valve comprising;

a valve seat comprising a valve seat surface defining a conical flow path including a conical surface that gradually decreases in diameter in the direction of flow of fuel, and an injection port with a cylindrical surface including a central axis slanted with respect to the central axis of said conical flow path;

a valve member having a substantially conical tip for contacting and separating with respect to said valve seat surface to control supply of fuel into said injection port; and an actuator for actuating said valve member, wherein, an intermediate flow path having a cylindrical surface coaxial to said conical flow path is provided between said conical flow path and said injection port; and a portion of said cylindrical surface of said injection port is connected to said conical surface of said conical flow path and another portion of said cylindrical surface of said injection port is connected to said cylindrical surface of said intermediate flow path;

whereby generation of stagnation of flow of fuel is suppressed.

2. A fuel injection valve as claimed in claim 1, wherein said intermediate flow path has a tapered conical surface that is connected to a downstream side end portion of said cylindrical surface of said intermediate flow path and that includes a diameter which gradually decreases in the direction of flow of fuel, and wherein a still another portion of said cylindrical surface of said injection port is connected to said tapered conical surface of said intermediate flow path.

3. A fuel injection valve as claimed in claim 2, wherein a cone apex angle of said conical surface of said intermediate flow path is smaller than a cone apex angle of said valve seat surface.

* * * * *